US007503321B2

(12) United States Patent
Afshari

(10) Patent No.: US 7,503,321 B2
(45) Date of Patent: Mar. 17, 2009

(54) ILLUMINATED SIGHT PIN

(76) Inventor: Abbas Ben Afshari, 1553 E. Center, Pocatello, ID (US) 83201

( * ) Notice: Subject to any disclaimer, the term of this patent is extended or adjusted under 35 U.S.C. 154(b) by 169 days.

(21) Appl. No.: 11/375,282

(22) Filed: Mar. 14, 2006

(65) Prior Publication Data

US 2006/0156561 A1 Jul. 20, 2006

Related U.S. Application Data

(63) Continuation of application No. 10/795,211, filed on Mar. 5, 2004, now abandoned, which is a continuation of application No. 09/991,243, filed on Nov. 20, 2001, now Pat. No. 6,725,854.

(60) Provisional application No. 60/264,461, filed on Jan. 26, 2001.

(51) Int. Cl.
*F41G 1/467* (2006.01)

(52) U.S. Cl. ..... 124/87; 33/265; 42/132

(58) Field of Classification Search ..... 124/87; 33/265; 42/113, 132, 145
See application file for complete search history.

(56) References Cited

U.S. PATENT DOCUMENTS

| | | | | |
|---|---|---|---|---|
| 3,234,651 | A | 2/1966 | Rivers | |
| 3,455,027 | A | 7/1969 | Perkins | |
| 3,475,820 | A | 11/1969 | Kernan | |
| 3,521,362 | A | 7/1970 | Duplechin | |
| 3,641,675 | A | 2/1972 | Funk, Jr. | |
| 3,648,376 | A | 3/1972 | Millnamow | |
| 3,945,127 | A | 3/1976 | Spencer | |
| 3,997,974 | A | 12/1976 | Larson | |
| 4,070,763 | A | 1/1978 | Carts, Jr. | 42/132 |
| 4,116,194 | A | 9/1978 | Topel | |
| 4,120,096 | A | 10/1978 | Keller | |
| 4,159,575 | A | 7/1979 | Kalmbach | |
| 4,162,579 | A | 7/1979 | James | |
| 4,177,572 | A | 12/1979 | Hindes | |
| 4,215,484 | A | 8/1980 | Lauffenburger | |
| 4,244,115 | A | 1/1981 | Waldorf | |
| 4,291,469 | A | 9/1981 | Weast | 33/265 |
| 4,291,664 | A | 9/1981 | Nishioka | |
| 4,418,479 | A | 12/1983 | Stachnik | |

(Continued)

FOREIGN PATENT DOCUMENTS

| | | |
|---|---|---|
| WO | WO 97/32175 | 9/1997 |

OTHER PUBLICATIONS

"Skylight." *Black Gold Premium Bowsights*. p. 1. <http://www.blackgoldsights.com/skylight_sights.html> Jun. 13, 2006.

(Continued)

*Primary Examiner*—Stephen M Johnson
(74) *Attorney, Agent, or Firm*—Morriss O'Bryant Compagni

(57) ABSTRACT

A sighting device for use with a firearm or bow comprises a fiber optic member having a sight end visible by a user for aiming the firearm or bow at a target. A non-electrical, light-emitting material is disposed over a length of the fiber optic element in order to illuminate the fiber optic element in low light or no ambient light conditions. The non-electrical, light-emitting material may be incorporated into the sighting device in order to provide sufficient surface contact with the fiber optic member to provide adequate illumination as well as illumination of the sighting device itself.

26 Claims, 9 Drawing Sheets

U.S. PATENT DOCUMENTS

| | | | | |
|---|---|---|---|---|
| 4,528,973 | A | 7/1985 | Rasmussen | 124/87 |
| 4,541,179 | A | 9/1985 | Closson | |
| 4,616,623 | A | 10/1986 | Williams | 124/87 |
| 4,884,347 | A | 12/1989 | Larson | |
| 4,928,394 | A | 5/1990 | Sherman | |
| 4,977,678 | A | 12/1990 | Sears | |
| 5,086,567 | A | 2/1992 | Tutsch | |
| 5,090,805 | A | 2/1992 | Stawarz | 124/87 |
| 5,103,568 | A | 4/1992 | Canoy | |
| 5,131,153 | A | 7/1992 | Seales | |
| 5,174,269 | A | 12/1992 | Sappington | |
| 5,201,122 | A | 4/1993 | Annunziata | 124/87 |
| 5,231,765 | A | 8/1993 | Sherman | |
| 5,285,767 | A | 2/1994 | Padilla | |
| 5,341,791 | A | 8/1994 | Shafer | 124/87 |
| 5,362,046 | A | 11/1994 | Sims | |
| 5,367,780 | A | 11/1994 | Savage | |
| 5,383,278 | A | 1/1995 | Kay | 33/265 |
| 5,383,279 | A | 1/1995 | Tami | |
| 5,442,861 | A | 8/1995 | Lorocco | |
| 5,442,863 | A | 8/1995 | Fazely | |
| 5,517,979 | A | 5/1996 | Closson | |
| 5,560,113 | A | 10/1996 | Simo et al. | |
| 5,579,752 | A | 12/1996 | Nelson et al. | |
| 5,619,801 | A | 4/1997 | Slates | |
| 5,632,091 | A | 5/1997 | Brion et al. | |
| 5,634,278 | A | 6/1997 | London | |
| 5,638,604 | A | 6/1997 | Lorocco | |
| 5,644,849 | A | 7/1997 | Slates | |
| 5,653,034 | A | 8/1997 | Bindon | 42/131 |
| 5,653,217 | A | 8/1997 | Keller | |
| 5,676,122 | A | 10/1997 | Wiseby et al. | |
| 5,685,081 | A | 11/1997 | Winegar | |
| 5,718,215 | A | 2/1998 | Kenny et al. | |
| 5,836,294 | A | 11/1998 | Merritt | |
| 5,862,603 | A | 1/1999 | Ellig | |
| 5,894,672 | A | 4/1999 | Ellenburg et al. | 33/265 |
| 5,924,234 | A | 7/1999 | Bindon et al. | 42/123 |
| 5,956,854 | A | 9/1999 | Lorocco | |
| 5,996,569 | A | 12/1999 | Wilson | 33/265 |
| 6,000,141 | A * | 12/1999 | Afshari | 33/265 |
| 6,016,608 | A | 1/2000 | Lorocco | |
| 6,061,919 | A | 5/2000 | Reichert | |
| 6,119,672 | A | 9/2000 | Closson | |
| 6,122,833 | A | 9/2000 | Lorocco | |
| 6,145,208 | A | 11/2000 | Savage | |
| 6,216,352 | B1 | 4/2001 | Lorocco | |
| 6,276,068 | B1 | 8/2001 | Sheliga | |
| 6,360,472 | B1 | 3/2002 | Lorocco | |
| 6,382,201 | B1 | 5/2002 | McPherson et al. | |
| 6,385,855 | B1 * | 5/2002 | Tymianski | 33/265 |
| 6,418,633 | B1 * | 7/2002 | Rager | 33/265 |
| 6,421,946 | B1 | 7/2002 | LoRocco | |
| 6,477,778 | B1 | 11/2002 | Lorocco | |
| 6,494,604 | B2 | 12/2002 | Khoshnood | |
| 6,560,884 | B1 | 5/2003 | Afshari | |
| 6,601,308 | B2 | 8/2003 | Khoshnood | |
| 6,634,110 | B2 | 10/2003 | Johnson | |
| 6,634,111 | B2 | 10/2003 | LoRocco | |
| 6,725,854 | B1 | 4/2004 | Afshari | |
| 6,817,105 | B2 | 11/2004 | LoRocco | 33/265 |
| 2002/0073560 | A1 * | 6/2002 | LoRocco | 33/265 |
| 2004/0006879 | A1 | 1/2004 | Afshari | |
| 2004/0088871 | A1 | 5/2004 | Afshari | |

OTHER PUBLICATIONS

"Radiant." *Black Gold Premium Bowsights*. p. 1. <http://www.blackgoldsights.com/radiant_bowsight.html> Jun. 13, 2006.

"Dusk Devil Ultimate." *Black Gold Premium Bowsights*. p. 1. <http://www.blackgoldsights.com/dusk_devil_ult_bowsight.html> Jun. 13, 2006.

"Dusk Devil Ultimate Hunter." *Black Gold Premium Bowsights*. p. 1. <http://www.blackgoldsights.com/dusk_devil_hunter_bowsight.html> Jun. 13, 2006.

"Dusk Devil2." *Black Gold Premium Bowsights*. p. 1. <http://www.blackgoldsights.com/dusk_devil2_bowsight.html> Jun. 13, 2006.

"Quest." *Black Gold Premium Bowsights*. p. 1. <http://www.blackgoldsights.com/quest.html> Jun. 13, 2006.

"Cobra Bow Sights." *Big Game Pro Shop*. pp. 1-4. <http://www/biggameproshop.com/cobra-bow-sights.htm> Jun. 12, 2006.

"Hoyt Custom Accessories: Sights." Hoyt.com. pp. 1-2. <http://www.hoyt.com/products/sights.tpl> Jun. 12, 2006.

"Airlite NI-138." *Impact Archery*. pp. 1-2. <http://www.impactarchery.com/airlite.html> Jun. 13, 2006.

"Airlite XL NI-139." *Impact Archery*. pp. 1-2. <http://www.impactarchery.com/airlitexl.html> Jun. 13, 2006.

"Airlite DX NI-143." *Impact Archery*. p. 1. <http://www.impactarchery.com/airlitedx.html> Jun. 13, 2006.

"Airlite MDX NI-144." *Impact Archery*. p. 1. <http://www.impactarchery.com/airlitemdx.html> Jun. 13, 2006.

"All Terrain NI-175." *Impact Archery*. pp. 1-2. <http://www.impactarchery.com/allterrain.html> Jun. 13, 2006.

"Bravo NI-126." *Impact Archery*. pp. 1-2. <http://www.impactarchery.com/bravo.html> Jun. 13, 2006.

"Collector NI-150." *Impact Archery*. p. 1. <http://www.impactarchery.com/collector.html> Jun. 13, 2006.

"Cosmic NI-135." *Impact Archery*. pp. 1-2. <http://www.impactarchery.com/cosmic.html> Jun. 13, 2006.

"Cosmic XI-136." *Impact Archery*. pp. 1-2. <http://www.impactarchery.com/cosmicxl.html> Jun. 13, 2006.

"Cosmic DX NI-145." *Impact Archery*. p. 1 <http://www.impactarchery.com/cosmicdx.html> Jun. 13, 2006.

"Cosmic MDX NI-146." *Impact Archery*. p. 1 <http://www.impactarchery.com/cosmicmdx.html> Jun. 13, 2006.

"Cross Air NI-137." *Impact Archery*. p. 1 <http://www.impactarchery.com/crossair.html> Jun. 13, 2006.

"Fiber Tech NI-151." *Impact Archery*. pp. 1-2. <http://www.impactarchery.com/fibertech.html> Jun. 13, 2006.

"Full Draw NI-200." *Impact Archery*. p. 1. <http://www.impactarchery.com/fulldraw.html> Jun. 13, 2006.

"Hammerhead 3 NI-153." *Impact Archery*. p. 1. <http://www.impactarchery.com/hammerhd3.html> Jun. 13, 2006.

"Hammerhead 5 NI-155." *Impact Archery*. p. 1. <http://www.impactarchery.com/hammerhd5.html> Jun. 13, 2006.

"Hunter NI-102." *Impact Archery*. p. 1. <http://www.impactarchery.com/hunter.html> Jun. 13, 2006.

"Impact 3 NI-100." *Impact Archery*. p. 1. <http://www.impactarchery.com/impact3.html> Jun. 13, 2006.

"Impact 3 Lite NI-101." *Impact Archery*. p. 1. <http://www.impactarchery.com/impact3lite.html> Jun. 13, 2006.

"Jumbo NI-161." *Impact Archery*. p. 1. <http://www.impactarchery.com/jumbo.html> Jun. 13, 2006.

"Jumbo Plus NI-161P." *Impact Archery*. p. 1. <http://www.impactarchery.com/jumboplus.html> Jun. 13, 2006.

"Omega NI-131." *Impact Archery*. p. 1. <http://www.impactarchery.com/omega.html> Jun. 13, 2006.

"Omega XL NI-132." *Impact Archery*. p. 1. <http://www.impactarchery.com/omegaxl.html> Jun. 13, 2006.

"Omega DX NI-133." *Impact Archery*. p. 1. >http://www.impactarchery.com/omegadx.html> Jun. 13, 2006.

"Omega MDX NI-134." *Impact Archery*. p. 1. <http://www.impactarchery.com/omegamdx.html> Jun. 13, 2006.

"Orbit NI-103." *Impact Archery*. p. 1. <http://www.impactarchery.com/orbit.html> Jun. 13, 2006.

"Quad NI-170." *Impact Archery*. pp. 1-2. <http://www.impactarchery.com/quad.html> Jun. 13, 2006.

"Selector NI-120." *Impact Archery*. pp. 1-2. <http://www.impactarchery.com/selector.html> Jun. 13, 2006.

"Solo NI-160." *Impact Archery*. p. 1. <http://www.impactarchery.com/solo.html> Jun. 13, 2006.

"Solo Plus NI-160P." *Impact Archery*. p. 1. <http://www.impactarachery.com/soloplus.html> Jun. 13, 2006.
"Solo DX NI-165." *Impact Archery*. p. 1. <http://www.impactarchery.com/solodx.html> Jun. 13, 2006.
"Solo Plus DX NI-165P." *Impact Archery*. p. 1. <http://www.impactarchery.com/soloplusdx.html> Jun. 13, 2006.
"Solo Plus MDX with 6" Extension NI-166." *Impact Archery*. p. 1. <http://www.impactarchery.com/soloplusmdx6.html> Jun. 13, 2006.
"Tree Top NI-130." *Impact Archery*. pp. 1-2. <http://www.impactarchery.com/treetop.html> Jun. 13, 2006.
"Trio NI-163." *Impact Archery*. pp. 1-2. <http://www.impactarchery.com/trio.html> Jun. 13, 2006.
"Vortex NI-104." *Impact Archery*. p. 1. <http://www.impactarchery.com/vortex.html> Jun. 13, 2006.
"PSE Archery: PSE Sights." Wyomingmade.com. pp. 1-4. <http://www.wyomingmade.com/sights.htm> Jun. 12, 2006.
"Hunting Sights." *Toxonics Manufacturing, Inc.: World Class Archery Sights*. pp. 1-4. <http://www.toxonics.com/hunting_sights.html> Jun. 13, 2006.
"Rhino." *Trophy Ridge*. pp. 1-5. <http://www.trophyridge.com/Trophy-Ridge-Products/Rhino/> Jun. 13, 2006.
"Titan." *Trophy Ridge*. pp. 1-4. <http://www.trophyridge.com/Trophy-Ridge-Products/Titan/> Jun. 13, 2006.
"Matrix." *Trophy Ridge*. pp. 1-4. <http://www.trophyridge.com/Trophy-Ridge-Products/Matrix/> Jun. 13, 2006.
"Mantis." *Trophy Ridge*. pp. 1-5. <http://www.trophyridge.com/Trophy-Ridge-Products/Mantis/> Jun. 13, 2006.
"Nitro Xtreme." *Trophy Ridge*. pp. 1-3. <http://www.trophyridge.com/Trophy-Ridge-Products/Nitro/> Jun. 13, 2006.
"Flatliner." *Trophy Ridge*. pp. 1-4. <http://www.trophyridge.com/Trophy-Ridge-Products/Flatliner/> Jun. 13, 2006.
"EZ Universal." *Trophy Ridge*. pp. 1-2. <http://www.trophyridge.com/Trophy-Ridge-Products/Ezuniversal/> Jun. 13, 2006.
"Summit." *Trophy Ridge*. pp. 1-4. <http://www.trophyridge.com/Trophy-Ridge-Products/Summit/> Jun. 13, 2006.
Savage Systems, Inc. product catalog; 2000; Oak Grove, Louisiana; pp. 1-12.
Trophy Ridge product catalog; 2003; Belgrade, Montana; pp. 1-11.
Trophy Ridge product catalog; 2004; Belgrade, Montana pp. 1-16.
Scout Mountain Equipment product catalog; Pocatello, Idaho; 1996; pp. 1-7.
Jennifer Pillath; Bass Pro Shops Outdoor World, vol. 1-Issue 1; Sep. 2002.
Larry D. Jones; Bowhunter; Aug./Sep. 2002, pp. 18, 46 and unknown.
Bill Krenz; Better Hunting Sights; Bowhunter; Oct./Nov. 2002 (unknown page).
Mike Strandlund; Tackle & Technique A Better Way to Aim; Bowhunting World; Jun. 2002; p. 70.
Taming Bow Torque; Bowhunting World; Aug. 2002; pp. 91-92.
Guns & Gear; Jun. 2002; Introducing New Extreme Gear.
Richard Combs; Bow Sights 2002; Archery Business; Mar./Apr. 2002; pp. 54-56 and 66.
Truglo Product Catalog; 2001; pp. 1-20; McKinney, Texas.
Whitetail Bowhunter; AMO Uniting the Industry; 2001; pp. 87,96 and unknown.
Cabela's catalog; date unknown; p. 803.
Bill Krenz; Trophy Ridge Mantis and Vdrive Sights; Inside Archery; Feb. 2004; pp. 92, 52 and unknown.
Bill Krenz; Five Star Bow Report; Bowhunt America; Feb./Mar. 2004; pp. 50, 61 and unknown.
Richard Combs; Bow Sights 2002; Archery Business; Mar./Apr. 2002; pp. 54-59.
Bow Masters; Feb. 2002; pp. 16, 23 unknown.
Bow Masters; Buyer's Guide; Aug. 2002; p. 45.
Cabela's Archery catalog; 2004; pp. 60-61, 65.
Cobra Manufacturing Co., Inc. website printout; www/cobraarchery.com; Cobra Accessories; 2004; pp. 1-3.
Cobra Manufacturing Co., Inc. website printout; www.cobraarchery.com; Cobra Scopes; 2004; pp. 1-2.
Cobra Manufacturing Co., Inc. website printout; www.cobraarchery.com; Cobra Signature Scopes; 2004; pp. 1-2.
Sight Master website printout; www.sight-master.com; 2003; Townsend, Montana; pp. 1-6.
Carbon Impact product catalog; 1999; Traverse City, Missouri; pp. 1-8.
Toxonics Manufacturing, Inc. sight photographs; date unknown; Wentzville, Montana; pp. 1-7.
Majestic Hunter Bow Sight by Altier Archery, Mfg. photographs; date unknown; Honesdale, Pennsylvania; pp. 1-6.

* cited by examiner

ILLUMINATED SIGHT PIN

CROSS-REFERENCE TO RELATED APPLICATIONS

The present application is continuation of application Ser. No. 10/795,211 filed Mar. 5, 2004, now abandoned which is a continuation of application Ser. No. 09/991,243 filed Nov. 20, 2001, now U.S. Pat. No. 6,725,854 which claims the benefit of provisional Application No. 60/264,461, filed Jan. 26, 2001.

BACKGROUND OF THE INVENTION

1. Field of the Invention

This invention relates generally to sights for archery bows or firearms employing fiber optic elements and, more specifically, to sight pin constructions which provide increased stability to the fiber optic element and which provide illuminated sight capabilities in environments where ambient light is reduced or absent.

2. Description of the Art

Archery bow sights utilizing a plurality of sight pins have been known in the art for many years. Typically, these sights use a bracket or other mounting structure for mounting the sight to a bow. The sight is commonly comprised of a pin plate, a pin guard, and a plurality of sight pins which are secured to the pin plate and extend into a sight window formed by the pin guard. The sight is mounted to a bow in a manner so that when the bow string is drawn, the archer can look through a peep sight provided in the bow string and align the tip of a pin attached to the sight with a target. For sights utilizing a plurality of sight pins having their tips vertically aligned, each individual sight pin is typically provided for aiming the bow at a target at a particular distance from the archer. For example, one pin may be positioned in the sight for aiming the bow at a target 50 yards from the archer while another pin may be positioned for a target that is at 100 yards distance.

It is also known in the art to construct sight pins with a light-gathering fiber optic element to enable use of the sighting device in low light environments. Various configurations of sight pins using fiber optic members have been proposed. It is also well-recognized that the fiber optic elements of the sighting device are fragile and susceptible to damage.

Therefore, sighting devices have been constructed with pin guards to surround and protect the fiber optic element. Despite efforts to protect the fiber optic element of the sight pin, they are still vulnerable to damage from being brought into contact with bushes or other objects. Therefore, it would be advantageous to provide a protective member for the fiber optic element which would shield the sight pin from damage.

It is also well-known in the art that despite the light-gathering capabilities of fiber optic elements which render sighting devices more useful in low-light conditions (e.g., dusk) , there is a point at which the ambient light is so low that the fiber optic element is no longer capable of gathering sufficient light to provide any illumination. While others in the art have disclosed the use of electronic means for providing a light source to the fiber optic elements of the sighting device, the use of such devices add weight to the device, may fail electrically and are themselves vulnerable to damage by contact with bushes or the like.

It has also been proposed to provide a self illuminating substance such as tritium at one end of a fiber optic element in order to illuminate the opposite end. Because of the surface area of the ends of such fiber optic elements, the amount of light provided in such a small surface area is relatively low.

Thus, it would be advantageous in the art to provide a non-electrical source of light to the fiber optic elements of the sighting device that provides sufficient illumination to the fiber optic element to enhance the usefulness of the device in very low or no ambient light conditions.

SUMMARY OF THE INVENTION

In accordance with the present invention, a sighting element employing a fiber optic member for sighting illumination is structured to provide protection for the fiber optic member and is structured to provide a non-electric source of light to the fiber optic member in conditions of low or no ambient light. A sight pin of the present invention is further structured so that the non-electric light source is provided along a length of the fiber optic member in order to brighten the fiber optic element as a result of the light emanating from the non-electric light source.

In one embodiment, a sight pin of the present invention is further structured to stabilize the attachment of the sight pin to the pin plate of a sighting device.

In another embodiment, a sight pin is structured to eliminate the need for a peep sight in the bowstring.

In accordance with the invention, the sighting element may be structured for use with an archery bow or may be structured for use with a firearm.

In one embodiment of the invention, the sighting element is configured with a protective cover which fully or partially encapsulates the fiber optic member of a sight pin used with an archery bow. The protective cover is preferably a clear plastic or opaque material which allows ambient light to illuminate the fiber optic element.

In another embodiment of the invention, the sighting element is configured with a non-electric light source which provides illumination to the fiber optic member in conditions of low ambient light or no ambient light. The non-electric light source is preferably a material which naturally emits light, such as a radioactive or chemically activated material commonly used in such devices as illuminated watches and "glow-in-the-dark" signage. In addition, zinc sulfide and copper mixed phosphorescent pigments and powder materials can be incorporated into many materials such as plastics. Such luminescent plastic materials may be formed by mixing luminescent pigment powder with transparent plastic resin. The luminescent plastic can then be formed into the desired shape or applied to the product by casting, molding, extruding, dipping and/or coating. The luminescent pigment is compatible with acrylics, polyester, epoxy, polyvinyl chloride, polypropylene and polyethylene polymers.

While there are many such light-emitting materials that may be employed, another suitable material is tritium. The non-electric light source may be selectively positionable to bring the non-electric light source into registration with the fiber optic member to provide illumination thereto. Alternatively, as previously described, the non-electric light source may be formed with the fiber optic member in construction of the sighting element, as by casting, molding, extruding, dipping and/or coating so that the luminescent material is provided to the fiber optic member at all times.

In yet another embodiment of the invention, a sighting pin is structured to provide an illuminated dot or sighting bead, formed by the end of a fiber optic member, which is viewable only at a precise angle corresponding to a direct line-of-sight down the sight pin. The precision of sighting afforded by the configuration of the sight pin eliminates the need for using a peep sight on the bowstring.

BRIEF DESCRIPTION OF THE DRAWINGS

FIG. 18 is a view in elevation of the side of a protective cover for use with the pin arm shown in FIG. 17;

DETAILED DESCRIPTION OF THE INVENTION

Figure 1:
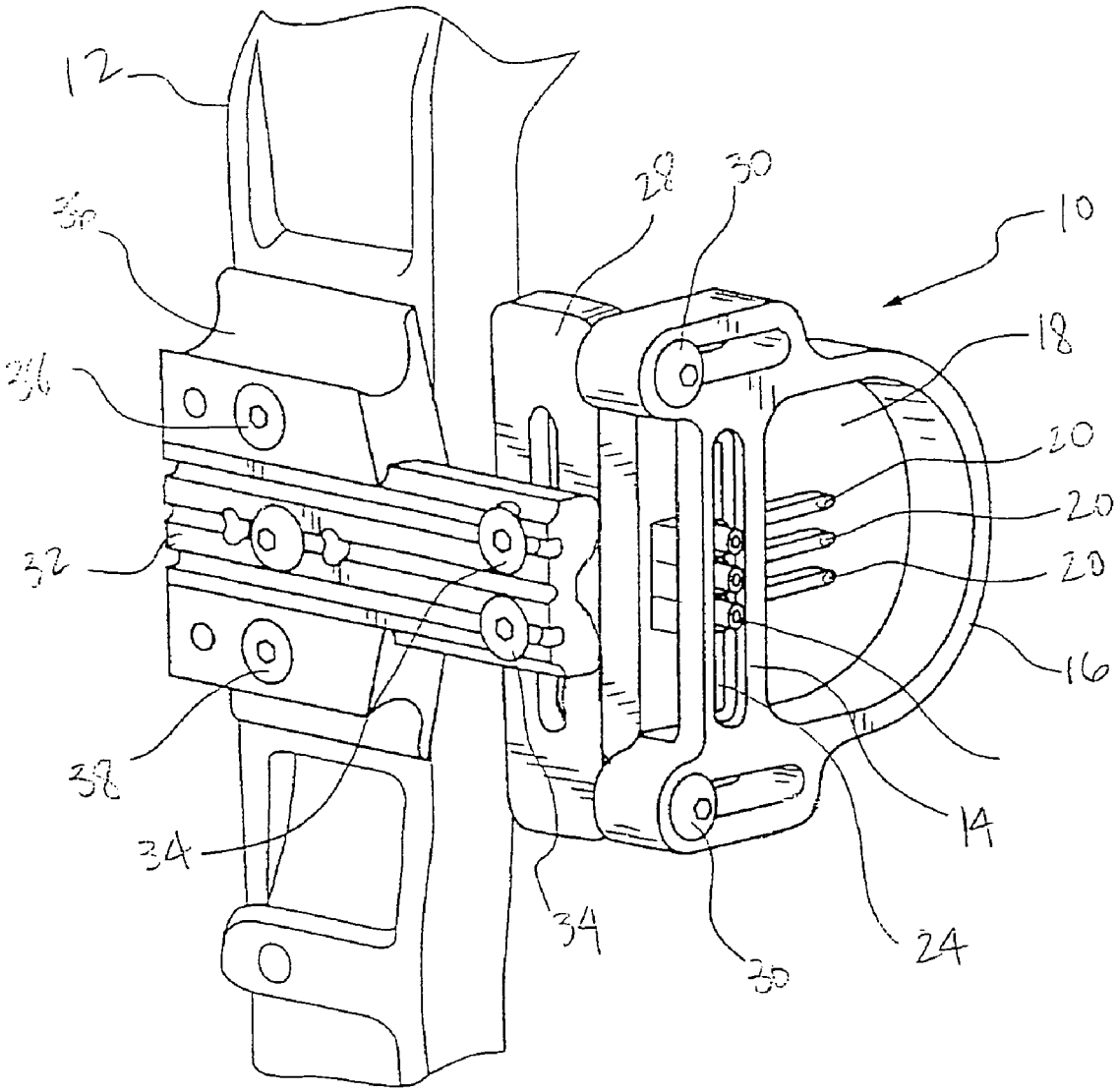
FIG. 1 is a perspective view of an archery sight illustrating its elements of construction and its attachment to an archery bow in accordance with the principles of the present invention.

FIG. 1 illustrates a bow sighting device 10 connected to an archery bow 12. The sighting device 10 is comprised of a pin plate 14, a pin guard 16 and a sight window 18 formed therebetween. A plurality of sight pins 20 are secured to the pin plate 14 by attachment members 22, such as screws, which engage the sight pins 20 and extend through a slot 24 formed in the pin plate 14. The sight pins 20 extend transversely from the pin plate 14 into the sight window 18. The sighting device 10 is attached to a first bracket 28 by securement members 30. The first bracket 28 may be adjustably connected to a second bracket 32 by securement members 34, and the second bracket 32 may be adjustable secured to a third bracket 36 by screw members 38, which attach it to the bow 12.

In use, the archer typically aligns a peep sight positioned on or formed in the bowstring with one of the sight pins 20. Each of the sight pins 20 is positioned and adjusted to correspond to a given distance (e.g., 50 yards, 100 yards, 150 yards, etc.) from the bow 12. The sight pins 20 allow the archer to better position the aim of the arrow to compensate for target distance and trajectory. Sight pins 20 relevant to the present invention are those which employ a fiber optic member in the sight pin to provide an illuminated point in reduced-light conditions.

Figure 2:
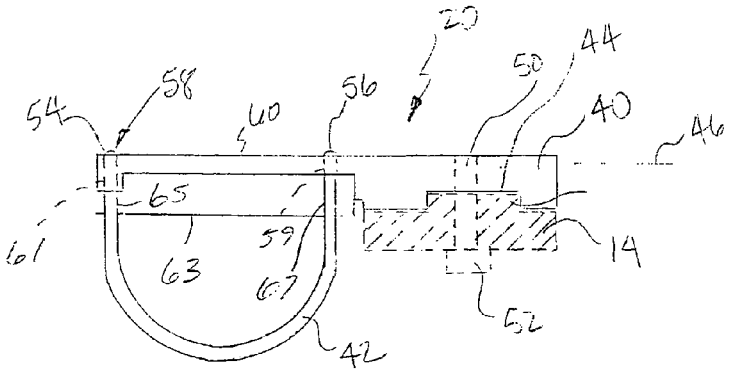
FIG. 2 is a view in elevation of a sight pin of the present invention.

FIG. 2 shows in better detail the configuration of a sight pin 20 which, in its simplest form, comprises an elongate pin member or pin arm 40 and a fiber optic member 42. The pin arm 40 is configured to be attachable to the pin plate 14 (shown in phantom) of a sighting device 10 (FIG. 1). By way of example only, the pin arm 40 of the sight pin 20 shown in FIG. 2 is configured with a slot or channel 44 extending transverse to the longitudinal axis 46 of the pin arm 40 which registers against a raised bar 48 formed along the length of the pin plate 14. An aperture 50 is formed through the pin arm 40 through which a securement member 52 (shown in phantom), such as a bolt or screw, is positioned to secure the sight pin 20 to the pin plate 14. The aperture 50 may be threaded to accept a screw 52 therethrough. The pin arm 40 in the embodiment shown in FIG. 2 is preferably made of lightweight metal to render the aperture 50 less susceptible to stripping when the sight pins 20 are moved or adjusted along the length of the pin plate 14, which requires adjustment of the securement member 52. The fiber optic member 42 of the embodiment shown in FIG. 2 is U-shaped and has a first end 54 and second end 56 which extend through the pin arm 40 and are spaced apart from each other. The first end 54 of the fiber optic member 42, which extends slightly proud of (i.e., extending beyond) the surface 60 of the pin arm 40, provides an illuminated sighting bead 58. The bead 58 as well as the second end 56 (having a similar configuration) are formed by heating the ends 56 and 58 of the fiber optic element to a temperature beyond the melting point of the material so as to form a bead on the ends 56 and 58 of the fiber optic member 42. The beads are larger than the apertures or holes 59 and 61, respectively, so as to prevent the ends 56 and 58 from pulling through the holes 59 and 61, respectively. The lateral force of the fiber optic member 42 in its tendency to return to a straight segment holds the ends 56 and 58 in relative position within the holes 59 and 61.

In order to illuminate the fiber optic member 42 in low light conditions, a luminescent member 63 is coupled to the fiber optic member 42 so as to partially or fully encapsulate or surround or abut one or more portions 65 and 67 of the fiber optic member 42 along a length thereof. In doing so, the illumination of the luminescent member 63 is captured by the fiber optic element or member 42 illuminating the ends 56 and 58. With the end 58 being the sighting end (i.e., the end of the sight pin 20 used to aim the bow at a target), the illumination of the end 58 allows a user to more clearly see the end 58 when trying to aim the bow at a desired target without losing sight of the aiming end 58 of the sight pin 20.

The luminescent member 63 is positioned behind the pin arm 40 so as to be substantially hidden from view by a user when looking at the sight pin 20 when aiming the bow to which the sight pin 30 is attached. As the arm 40 is formed from an opaque material, the lumination from the illuminating member 63 is blocked from view. In this manner, the illumination of the illuminating member 63 does not distract the user from seeing the illuminated end 58 of the fiber optic element 42.

Figure 3:
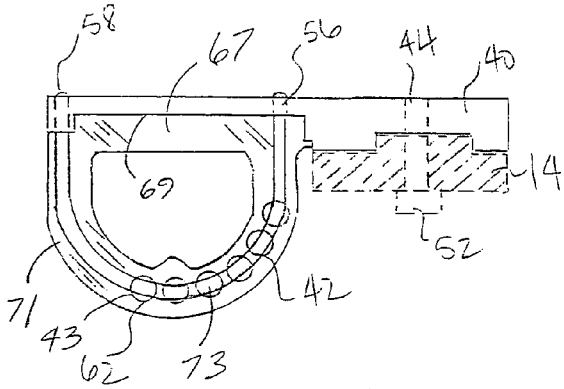
FIG. 3 is a view in elevation of a first embodiment of the invention illustrating a protective cover for the fiber optic member.

Because the fiber optic member 42 is very thin (approximately 0.3 to 0.5 mm in diameter), it may be vulnerable to breakage or damage. Thus, in one iteration of the invention shown in FIGS. 3 and 4, the sight pin 20 is structured with a protective cover 62 which wholly or partially supports, surrounds or encapsulates the fiber optic member 42 to stabilize it and thereby prevent damage. The protective cover 62 shown in FIG. 3 is generally arch or U-shaped to conform to the shape of the fiber optic member 42, which is completely embedded or encapsulated within the protective cover 62. It is also contemplated that the protective cover may have other configurations to accommodate fiber optic member shapes, such as straight, L-shaped J-shaped or others. The protective cover 62 has a base portion 67 that abuts against he back side 69 of the arm 40 and a U-shaped portion 71 that depends from the base portion 67 and supports the curved portion 73 of the fiber optic member 42. The protective cover 62 may be clear plastic or opaque. If it is desired to illuminate the fiber optic member 42, the protective cover 62 may be pigmented with a luminescent material in order to provide the protective cover with light emitting properties in low light conditions. Such luminescent pigment will render the protective cover 62 generally more opaque in nature. If such light emitting properties are not desired, the protective cover 62 should be sufficiently pervious to light (e.g., formed from a clear or substantially transparent material) to provide illumination to the fiber optic member 42 provided by the surrounding ambient light.

In addition, whether the protective cover 62 is formed from a glow-in-the-dark material one or more lenses., such as lens 43, are formed in the protective cover 62 and are positioned over the position of the fiber optic member 42. The lens 43 defines a convex surface on the protective cover 62 and is configured to gather ambient light and focus it onto the fiber optic member 42 or into the glow-in-the-dark material of the protective cover 62. By modifying the curvature of the lens 43, the focal point of the lens may be configured to focus light gathered by the lens 43 onto a surface of the fiber optic member 42 or in the interior of the fiber optic member 42.

Figure 4:
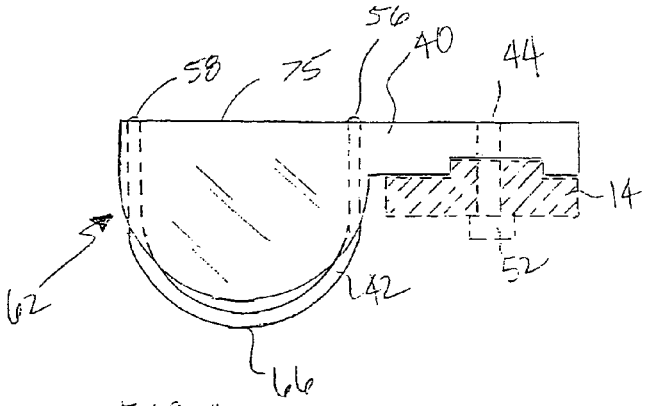
FIG. 4 is a view in elevation of a second embodiment of the invention illustrating a protective cover which only partial encapsulates the fiber optic member.

In the embodiment shown in FIG. 4, the protective cover 62 only partially encapsulates the fiber optic member 42, leaving the upper portion 66 of the fiber optic member 42 exposed to ambient light. In the particular embodiment shown, the protective cover 62 is integrally formed as part of the pin arm 40. However, the protective cover 62 need not be integrally formed with the pin arm 40. The protective cover 62 shown in FIG. 4 may be made of clear or opaque plastic. In addition, the protective cover 62 may be made of any other suitable material since, by its configuration, the upper portion 66 of the fiber optic member 42 is exposed, thereby enabling the fiber optic member 42 to collect ambient light when it may be beneficial to collect ambient light to illuminate the sight end 58 of the sight pin 40. By forming the protective cover 62 from a luminescent material, however, the fiber optic member 42 can gather light from the exposed portion 66 when ambient light is sufficient and rely on illumination from the protective cover 62 when light conditions diminish. In a situation where the protective cover 62, which is integral with the pin arm 40, is visible by the archer, the visible surface 75 surrounding the ends 56 and 58 of the fiber optic member 42 may be coated with an opaque material, such as a paint or coating material (e.g., black or dark colored ink, paint, or other materials in the art).

Figure 5:
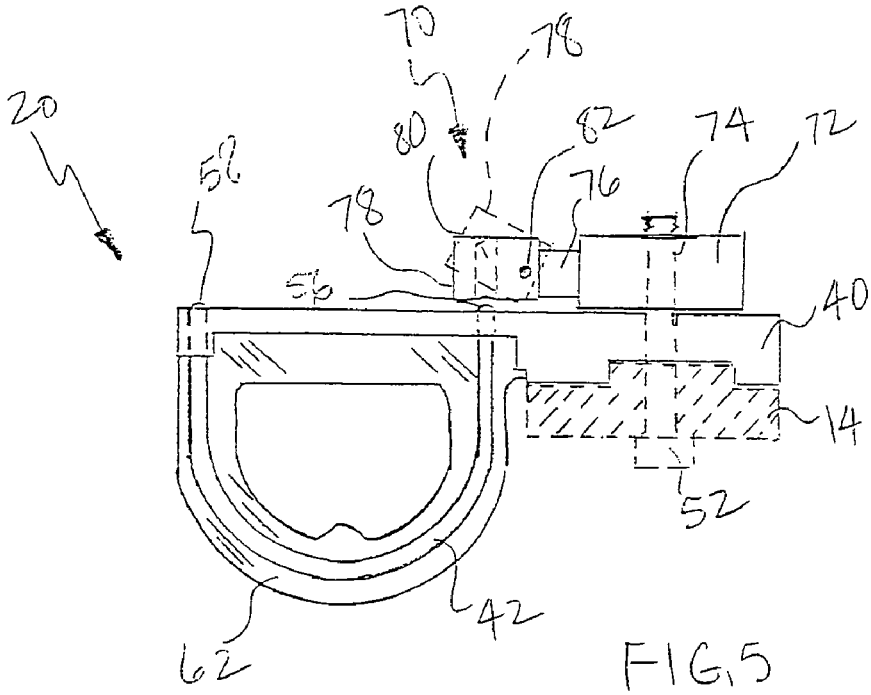
FIG. 5 is a view in elevation of a third embodiment of the invention illustrating a selectively positionable non-electric light-emitting source.

In another embodiment of the invention, the sight pin is structured with a non-electric, light-emitting element which provides illumination to the fiber optic member in conditions when ambient light it very low or non-existent, thereby rendering a sighting element still useful in such conditions. In one embodiment of the invention shown in FIG. 5, the sight pin 20 is structured with a pin arm 40 and fiber optic member 42, and the fiber optic member 42 may be enclosed in a protective cover 62 as previously described. In addition, a non-electric, light-emitting element 70 is selectively positionable in proximity to the fiber optic member 42 to provide a source of illumination thereto when desired by the user. In the embodiment illustrated in FIG. 5, the non-electric, light-emitting element 70 comprises a base 72 which overlies the pin arm 40 and is configured with a bore 74 which is aligned with the aperture 50 of the pin arm 40 to receive the securement member 52 (shown in phantom) therethrough. The bore 74 of the base 72 may be threaded, and the base 72 may preferably be made of metal, such as brass. A flange 76 extends from the base 72 in the direction of the sight bead 58 and provides a means for pivotally attaching a housing 78 thereto. The housing 78 contains a non-electric, light-emitting material 80, such as tritium or some other suitable luminescent material. The housing 78 is attached to the flange 76 by a pivot pin 82 such that the housing 78 may be pivoted out of registration (as shown in phantom) with the second end 56 of the fiber optic member 42 when ambient light is sufficient to illuminate the fiber optic member 42. However, when ambient light is low or non-existent, the housing 78 may be pivoted so that the non-electric, light-emitting material 80 is brought into registration with the second end 56 of the fiber optic member 42 and illumination is thereby provided to the fiber optic member 42. By allowing selective placement of the light-emitting material 80 over the end 56 of the fiber optic member 42, the light emitting member 80 can be moved away from the end 56 when light conditions are adequate. In such a way, the light-emitting member 80 and its associated housing 78 can be rotated away from the end 56 to allow ambient light to enter the end 56 to add illumination to the sighting end 58.

The illumination of the sight end 58 can be further enhanced by forming the protective member 62 from a luminescent material as well. As such, materials that are not necessarily conducive to being cast or molded into a structure such as the protective member 62 can be provided in the housing 78. The combination of light-emitting elements can provide a sufficiently bright sight end 58 of the fiber optic element 42.

Figure 6:
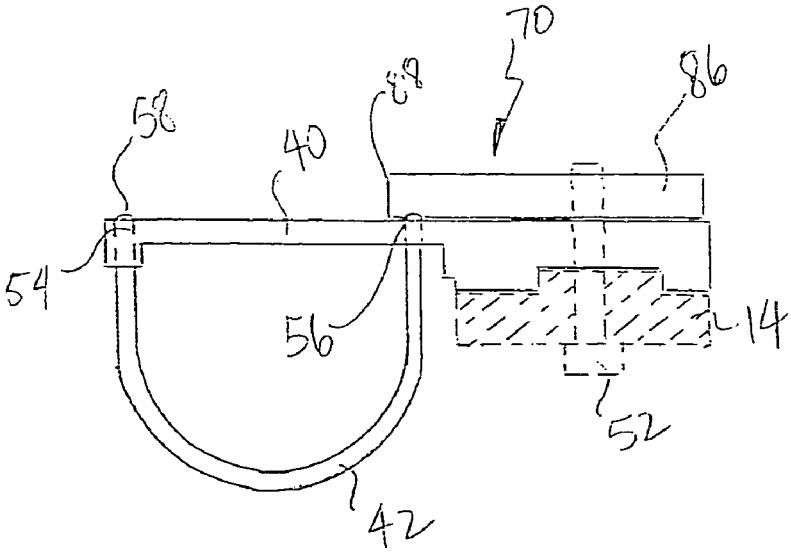
FIG. 6 is a view in elevation of a fourth embodiment of the invention illustrating an alternative means of providing a non-electric light-emitting source to a sight pin.

In an alternative embodiment shown in FIG. 6, the non-electric, light-emitting element 70 may be more permanently registered against the second end 56 of the fiber optic member 42. For example, a block 86 of light-emitting material may be secured to the pin arm 40 by means of the securement member 52 which attaches the sight pin 20 to the pin plate 14, and an end portion 86 overlies, or is in registration with, the second end 56 of the fiber optic member 42 to provide illumination to the sight bead 58 or first end 54 of the fiber optic member 42. The block may be any suitable material, such a plastic made from or containing a naturally radioactive, a phosphorescent substance, such as tritium, a luminescent pigment or other available luminescent materials.

As previously discussed, each of the embodiments herein, such as for example, the sight pin illustrated in FIG. 4, the protective cover 62 may be formed from a plastic material made from or containing a naturally radioactive or phosphorescent substances, such as tritium and the like.

Figure 7:
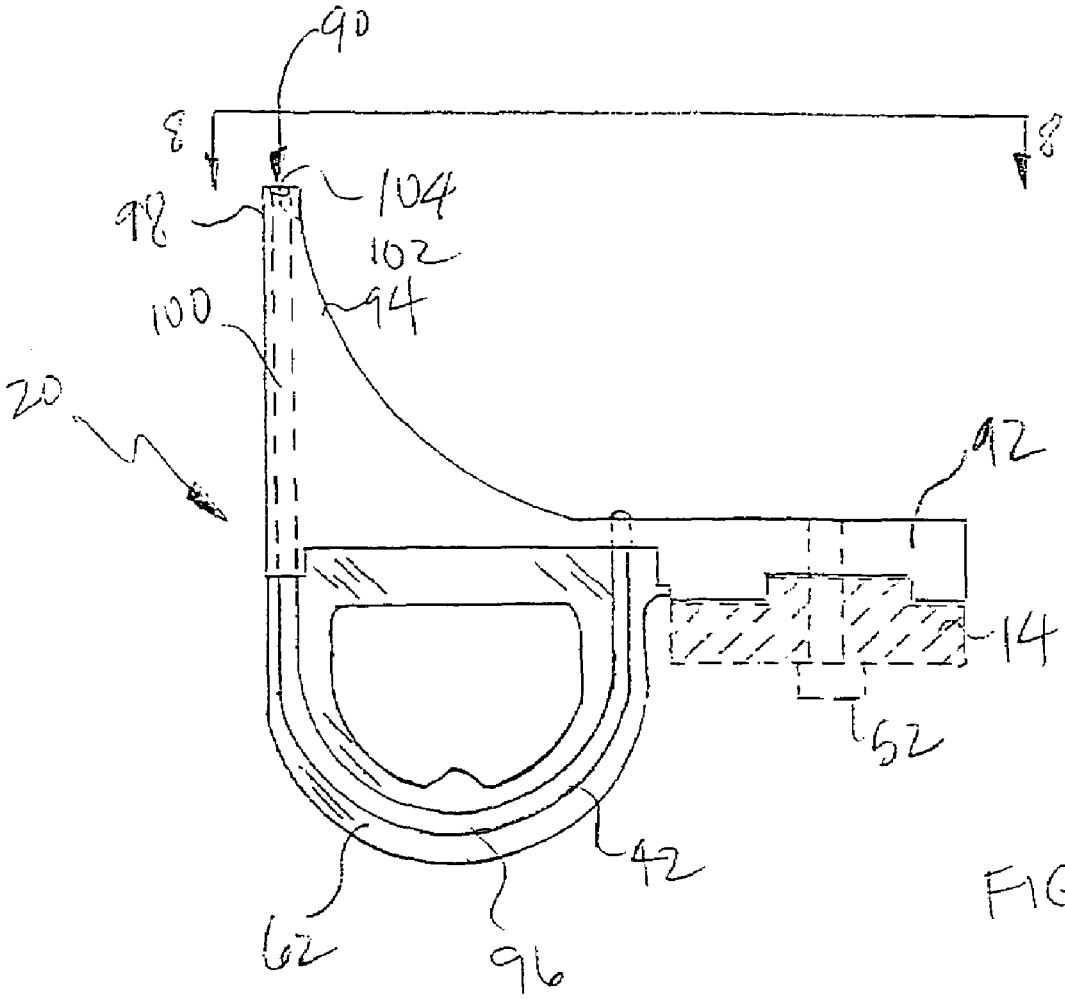
FIG. 7 is a view in elevation of a fifth embodiment of the invention configured to provide a direct line-of-sight means of sighting.
Figure 8:
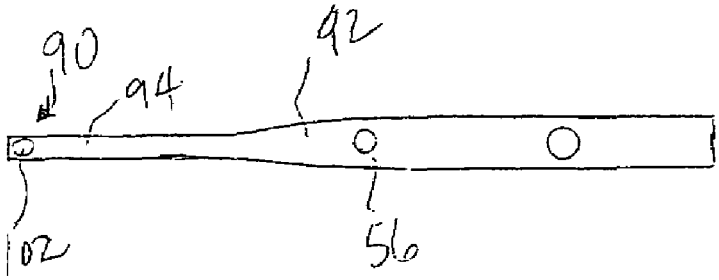
FIG. 8 is an illustration of the sight pin shown in FIG. 7 as viewed from line 8-8.

In yet another aspect of the invention, a sight pin 20 is structured to provide an illuminated sight bead 90 which is viewable only when the sight bead 90 is in direct line of sight to the archer's eye, an arrangement which effectively eliminates the need for a peep sight on the bowstring. In the embodiment shown in FIGS. 7 and 8, the sight pin 20 is structured with a pin arm 92 which is extended at one end 94 in a direction away from the curved portion 96 of the fiber optic member 42. Notably, the sight pin 20 of this embodiment may be structured with a protective cover 62 as shown, or may be structured without a protective cover 62. The extended end 94 of the pin arm 92 provides a tube-like terminus 98 and, as illustrated in FIG. 7, the fiber optic member 42 of this embodiment is extended at one end 100 though the tube-like terminus 98 of the pin arm 92 . The terminal end 102 of the fiber optic member 42 terminates just below the tip 104 of the terminus 98 so that the illuminated sight bead 90 provided by the terminal end 102 of the fiber optic member 42 is not viewable unless the eye of the archer is in a direct-line-of sight with the tube-like terminus 98 of the pin arm 92. Thus, the bow is only properly aligned with the target when the archer can see the sighting bead 90. By incorporating a light-emitting protective cover 62, the fiber optic member 42 can be illuminated in low light conditions. Similarly, other light-emitting structures described herein may be incorporated in the "peepless" sight pin 20.

Figure 9:
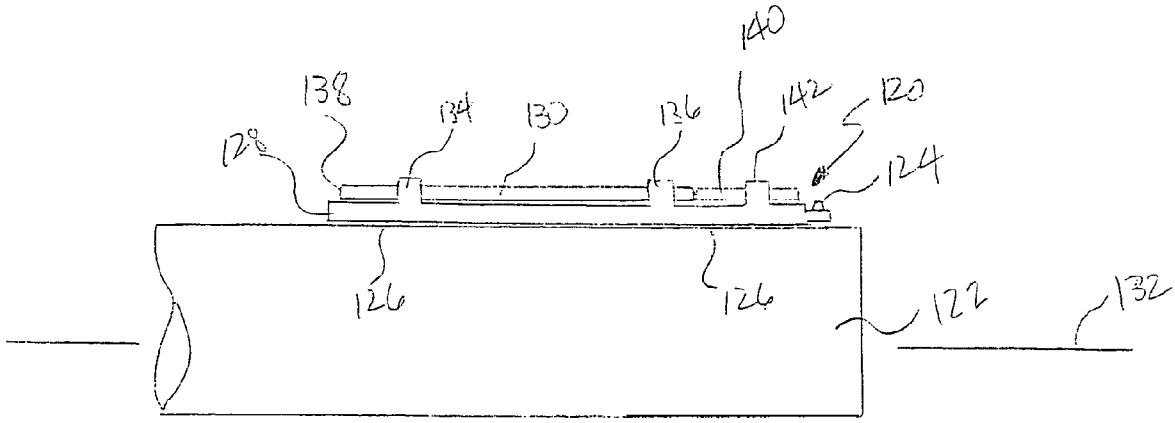
FIG. 9 is a view in elevation of the end of a barrel of a gun illustrating a sixth embodiment of the invention adapted for use on a firearm.
Figure 10:
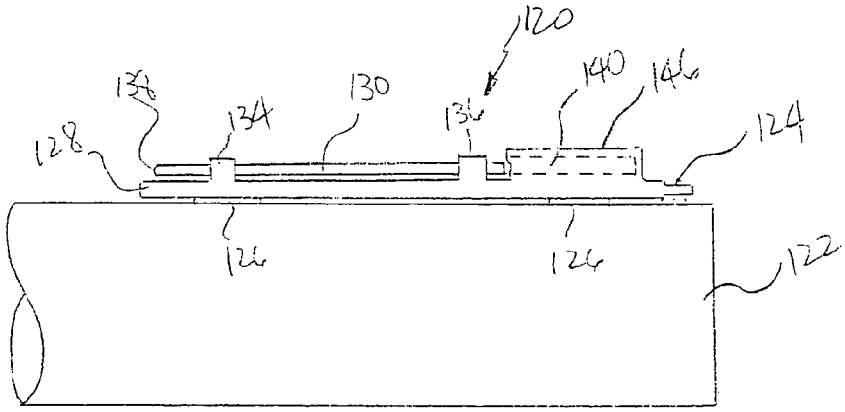
FIG. 10 is a view in elevation of the end of a barrel of a gun illustrating a seventh embodiment of the invention adapted for use on a firearm.
Figure 11:
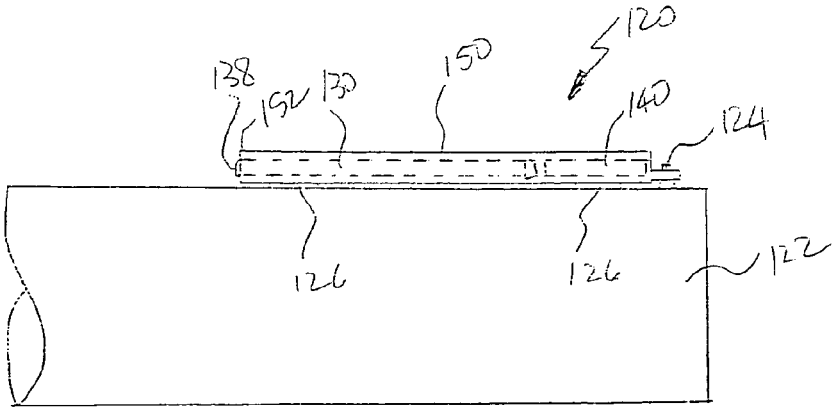
FIG.11 is a view in elevation of the end of a barrel of a gun illustrating an eighth embodiment of the invention adapted for use on a firearm.

The use of a non-electric, light-emitting material in a sighting device can also be adapted for use in a sighting device for firearms, as illustrated in FIGS. 9-11. As shown in FIG. 9, for example, a sighting device 120 may be attached to the terminal end of the barrel 122 of a firearm, and may be secured thereto by attachment to the sight 124 of the firearm and by, for example, means of magnetic members 126. The sighting device 120 may be comprised of a base 128 made, for example, from a lightweight rubber, polymer or plastic material. To the base 128 is secured a fiber optic member 130 which extends along the base 128 in alignment with the longitudinal axis 133 of the barrel. The fiber optic member 130 may, for example, be held in place on the base 128 by means of brackets 134, 136. The terminal end 138 of the fiber optic member 130 provides an illuminated sight bead. The sighting device 120 further comprises a non-electric, light-emitting member 140 which is coaxially aligned and in end-to-end registration with the fiber optic member 130. The light-emitting member 140 may be held in place by a bracket 142.

In an alternative embodiment shown in FIG. 10, the sighting device 120 may be structured to provide a base 128 and a fiber optic member 130 aligned along the longitudinal axis of the barrel 122, as previously described. However, the non-electric, light-emitting element 140 may be embedded in a housing portion 146 connected to the base 128. Again, the light-emitting element 146 is coaxially aligned with the fiber optic member 130 and is in end-to-end registration therewith to provide a source of illumination to the fiber optic member 130.

In another alternative embodiment of the invention shown in FIG. 11, the sighting device 120 may be structured as a tubular strip 150 of rubber, polymeric or plastic material in which is housed, in coaxial alignment and end-to-end registration, a linear fiber optic member 130 and a non-electric, light-emitting element 140. The terminal end 138 of the fiber optic member 130 extends from the end 152 of the tubular strip 150 to provide an illuminated sight bead. Alternatively, the tubular strip 150 may be made of a material which is formed from or which contains a naturally light-emitting or phosphorescent material. When the fiber optic member 130 is embedded or housed in the tubular strip, light emitted from the material of the tubular strip 152 illuminates the fiber optic member 130 and the sight bead at the terminal end 138.

Figure 12B:
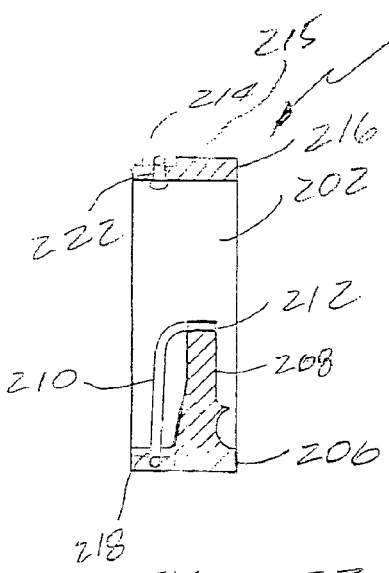
FIGS. 12A, 12B and 12C are front, cross-sectional side, and top views of a bow sight including a luminescent material to illuminate a fiber optic member of a sight pin illustrating a ninth embodiment of the invention adapted for use as a bow sight.
Figure 12A:
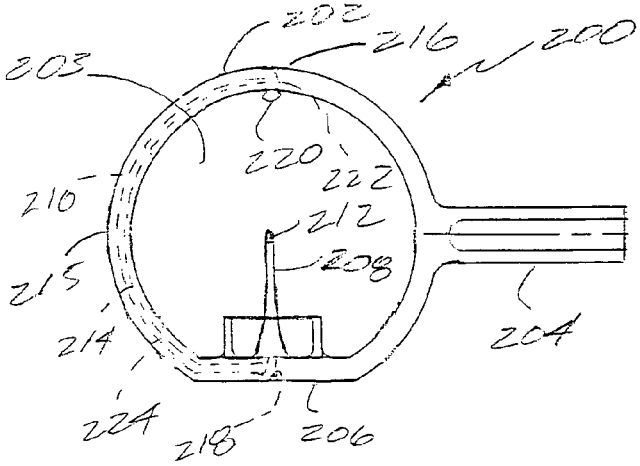
Figure 12C:
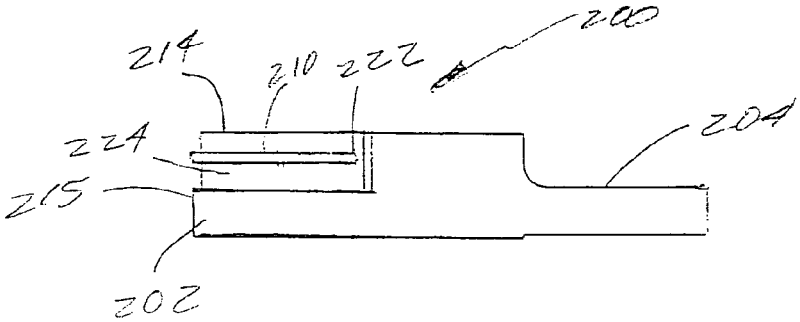
Figure 13:
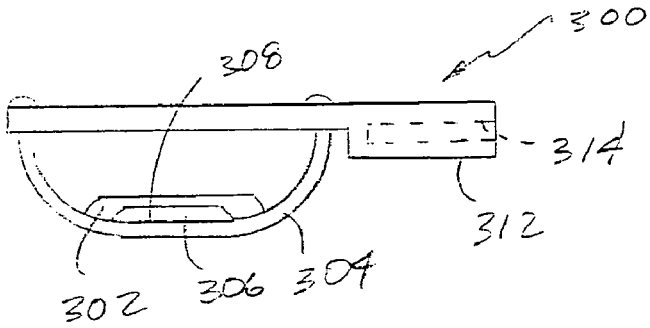
FIG. 13 is a view in elevation of the side of a tenth embodiment of the invention adapted for use in a bow sight.

Referring now to FIGS. 12A, 12B and 12C, a bow sight, generally indicated at 200, is illustrated in accordance with the principles of the present invention. The bow sight 200 is comprised of a pin guard 202 forming a sight window 203, a sight attachment portion 204, a pin attachment portion 206 and a sight pin 208 extending from the pin attachment portion 206 into the sight window 203. The sight pin 208 is fixed to the pin attachment portion 206 as by being integrally formed therewith. The sight pin 200 is provided with a single fiber optic member 210 having and end 212 that provides an aiming indicia or sight tip.

A channel or recessed portion 214 is provided in outer surface 215 of the pin guard 202 and extends along a length thereof from proximate the sight pin 208 to the top 216 of the pin guard 202. The fiber optic member 210 extends from the sight tip 212 through a hole 218 formed in the pin attachment portion 206, into the channel 214 and around the pin guard 202 to the top 216 thereof. The distal end 220 of the fiber optic element 210 extends through a hold 222 formed in the pin guard 202 and is secured thereto as by forming a head or bead on the distal end 220.

A layer of luminescent material 224, such as a strip of light emitting tape, is secured to the channel 214 as with an adhesive. The luminescent material 224 extends along a substantial length of the channel 214. The side of the fiber optic member 210 is positioned over the luminescent material so as to collect light emitted therefrom. By providing an extended length of the fiber optic material over the light emitting material 224, a significant amount of light can be gathered by the fiber optic member 210 for illuminating the proximal end 212 of the fiber optic element 210.

Additionally, by forming the pin guard 202 from a translucent material, such as a clear or semi-transparent plastic material, the luminescent material 224 can illuminate a portion of the pin guard 202 to also make at least a portion of the sight visible in low light conditions. By illuminating the sight 200 itself, the user can quickly locate the position of the sight 200 in low light conditions and then more quickly locate and focus on the illuminated sight end 212 of the sight pin 208. Thus, a single light-emitting member may be provided to illuminate both the fiber optic element and at least a portion of the sight 200 itself. Of course, the fiber optic element 210 and the sight 200 could be provided with separate light-emitting elements in order to separately and independently illuminate these structures.

FIGS. 13, 14, 15 and 16 illustrate four more embodiments of sight pins in accordance with the principles of the present invention. The sight pins 300, 320, 340 and 360 illustrate various other configurations contemplated within the scope of the present invention. The sight pin 300 is provided with a carrier 302 attached to the fiber optic element 304. The carrier 302 holds a piece 306 of luminescent material in contact with a portion 308 of the side of the fiber optic element 304. The luminescent material 306 is exposed on its sides in order to gather ambient light and emit the light to the fiber optic element in low light conditions. The sight pin 300 can be mounted at its mounting end 312 by inserting an externally threaded fastener (not shown) into internally threaded bore 314.

Figure 14:
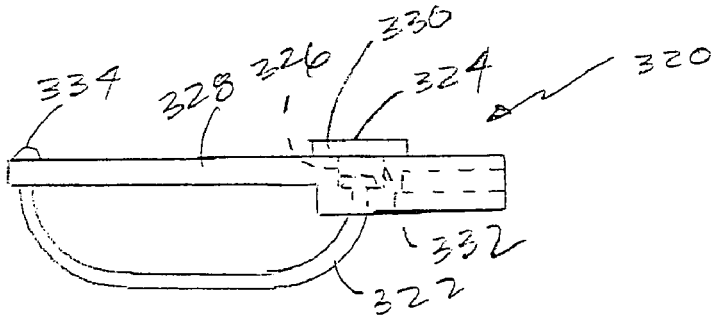
FIG. 14 is a view in elevation of the side of a eleventh embodiment of the invention adapted for use in a bow sight.

The sight pin 320 of FIG. 14 illustrates another way in which the fiber optic element 322 can be illuminated with a glow-in-the-dark material. A plug 324 formed of luminescent material is inserted into a hole 326 formed in the arm member 328 of the sight pin 320. The plug has a base portion 330 and an insert portion 332 sized to fit within the hole 326. The insert portion 32 is positioned adjacent one end of the fiber optic element 322 in order to provide illumination of the sight tip 334 in low light conditions.

Figure 15:
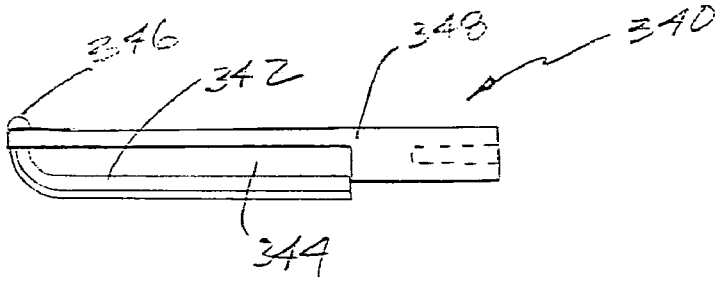
FIG. 15 is a view in elevation of the side of a twelfth embodiment of the invention adapted for use in a bow sight.

As shown in FIG. 15, it is also contemplated that the fiber optic element 342 of the sight pin 340 may have many different shapes or configurations. In this example, the fiber optic element 342 is housed within a protective casing 344 that protects the fiber optic element 342 and holds it in the desired position. The protective casing 344 is attached to an elongate sight pin arm 348 as by mechanical or adhesive attachment. The fiber optic element 342 has a generally J-shaped configuration with the end 346 forming the sight end being the only exposed end. The protective casing 344 is formed from a luminescent material to illuminate the fiber optic element 342 in low light conditions.

Figure 16:
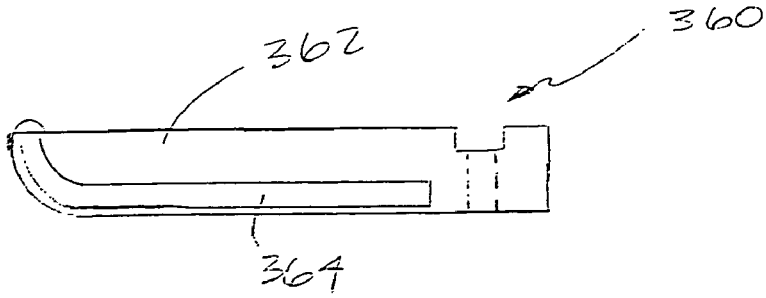
FIG. 16 is a view in elevation of the side of a thirteenth embodiment of the invention adapted for use in a bow sight.
Figure 16:
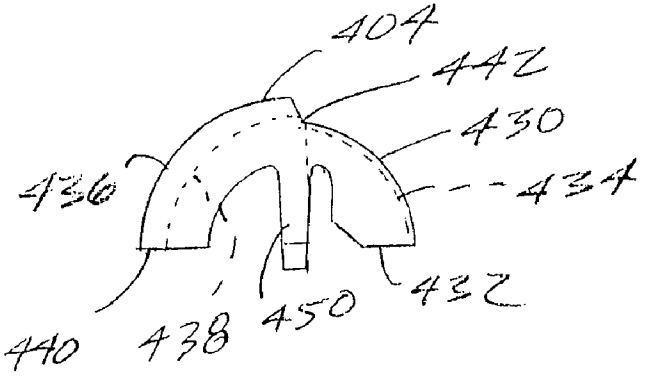

In FIG. 16, the sight pin arm 362 itself forms the protective cover or casing for the fiber optic element 364. As such the sight pin arm and protective cover are a single integrated component. Thus, the entire sight pin arm may be formed from a luminescent material.

Figure 17:
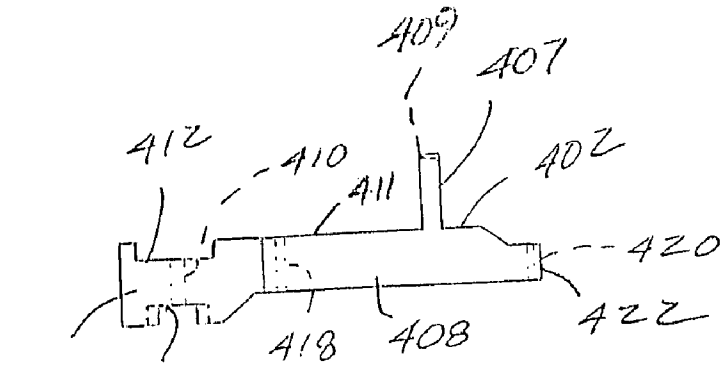
FIG. 17 is a view in elevation of the side of a fourteenth embodiment of a pin arm of the invention adapted for use in a bow sight.
Figure 19B:
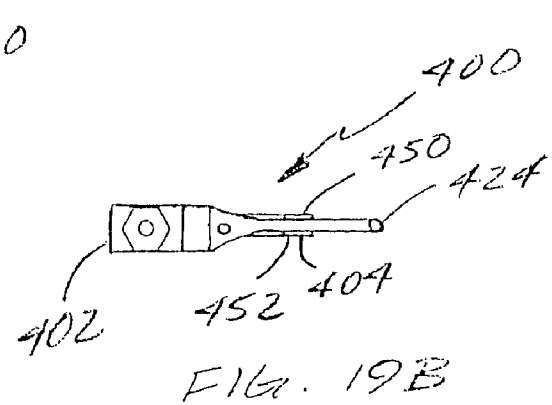
FIGS. 19A and 19B are views in elevation of the side and front of a sight pin when combining the pin arm of FIG. 17 and the protective cover of FIG. 18.
Figure 19A:
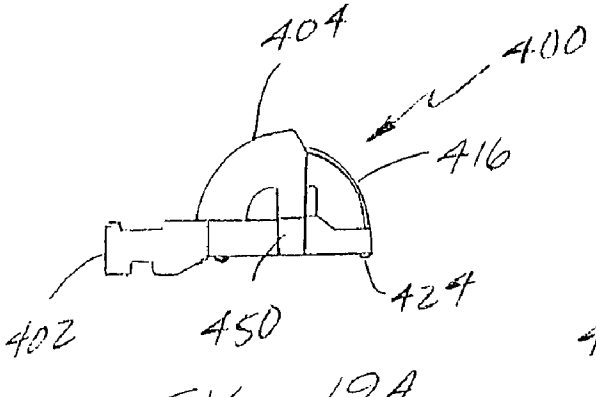

FIGS. 17 and 18 illustrate a sight pin arm 402 and a fiber optic member support/illuminating structure 404. When assembled, the sight pin arm 402 and support/illuminating structure 404 form the sight pin, generally indicated at 400, shown in FIGS. 19A and l9B. The sight pin arm is comprised of a mounting portion 406 and a fiber optic member support portion 408. In this example, the mounting portion 406 is configured to be mounted to the pin plate of a bow sight (not shown). The mounting portion includes a transversely extending hole 410 that extends between a channel 412 for abutting against and mating in a tongue and groove manner with a corresponding protrusion on the pin plate. On the opposite side of the mounting portion, a hexagonally shaped recess 414 is configured for receiving an hex nut. The shaft of a screw can then be inserted through the hole 410 and threaded into the nut to hold the pin arm 402 in place.

The fiber optic member support portion 408 is configured to be more narrow than the mounting portion 406 and includes a support strut or member 407 having a channel 409 for receiving a supporting a portion of the fiber optic member 416 that extends from the pin arm 402 to engage with the fiber optic member 416 to provide lateral stabilization thus reducing the risk of breaking of the fiber optic member 416. A pair of transversely extending holes 418 and 420 are provided in the pin arm 408 to hold the two ends of the fiber optic member 416 relative to the pin arm 408 with the hole 420 positioned proximate the end 422 or tip of the arm 408. The end 424 of the fiber optic member 416 exposed at the tip 422 provides the sighting indicia of the sight pin 400.

The fiber optic member 416 is further supported by the fiber optic member support/illuminating structure 404. The structure 404 is configured to support a fiber optic member in an arch-like configuration and thus has an arch-like shape itself. The structure 404 has a first portion 430 with a base portion 432 that abuts against the top of the pin arm 402 and defines a fiber optic member receiving channel 434 in which the fiber optic member 416 can rest while exposing the top of the fiber optic member 416 while positioned at least partially therein. The second portion 436 defines an interior channel 438 for supporting a portion of the fiber optic member 416 and encloses three sides of the fiber optic member 416. A base surface 440 of the second portion also abuts against the top surface of the pin arm 402. When engaged with the support 404, the fiber optic member 416 is inserted through an aperture 442 that is formed between the first and second portions 430 and 436, respectively.

Proximate a mid portion of the support 404, a pair of laterally extending tabs 450 and 452 are positioned to receive and abut against the support strut 407. The tabs 450 and 452 also extend below the top surface 411 of the pin arm 402 to abut against the sides of the pin arm 404 to provide lateral stability to the support 404. Such lateral stability helps to prevent the support from becoming forced in a direction perpendicular to the longitudinal axis of the fiber optic member 416 that could otherwise cause significant stress that could damage the fiber optic member 416 proximate the top surface 411 of the pin arm 402.

By forming the support 404 from a self-illuminating material, such as a glow-in-the-dark material, the fiber optic member 416 will be illuminated in low light conditions. Also, the support combines several features into a single component that provides support and protection of the fiber optic member 416, encapsulates a portion of the fiber optic member 416 for maximizing the illumination of the fiber optic member 416 in low light conditions and exposing a portion of the fiber optic member 416 along a length thereof for maximizing the ability of the fiber optic element to capture incidental light from the environment to illuminate the tip 424 in normal lighted conditions.

Figure 20:
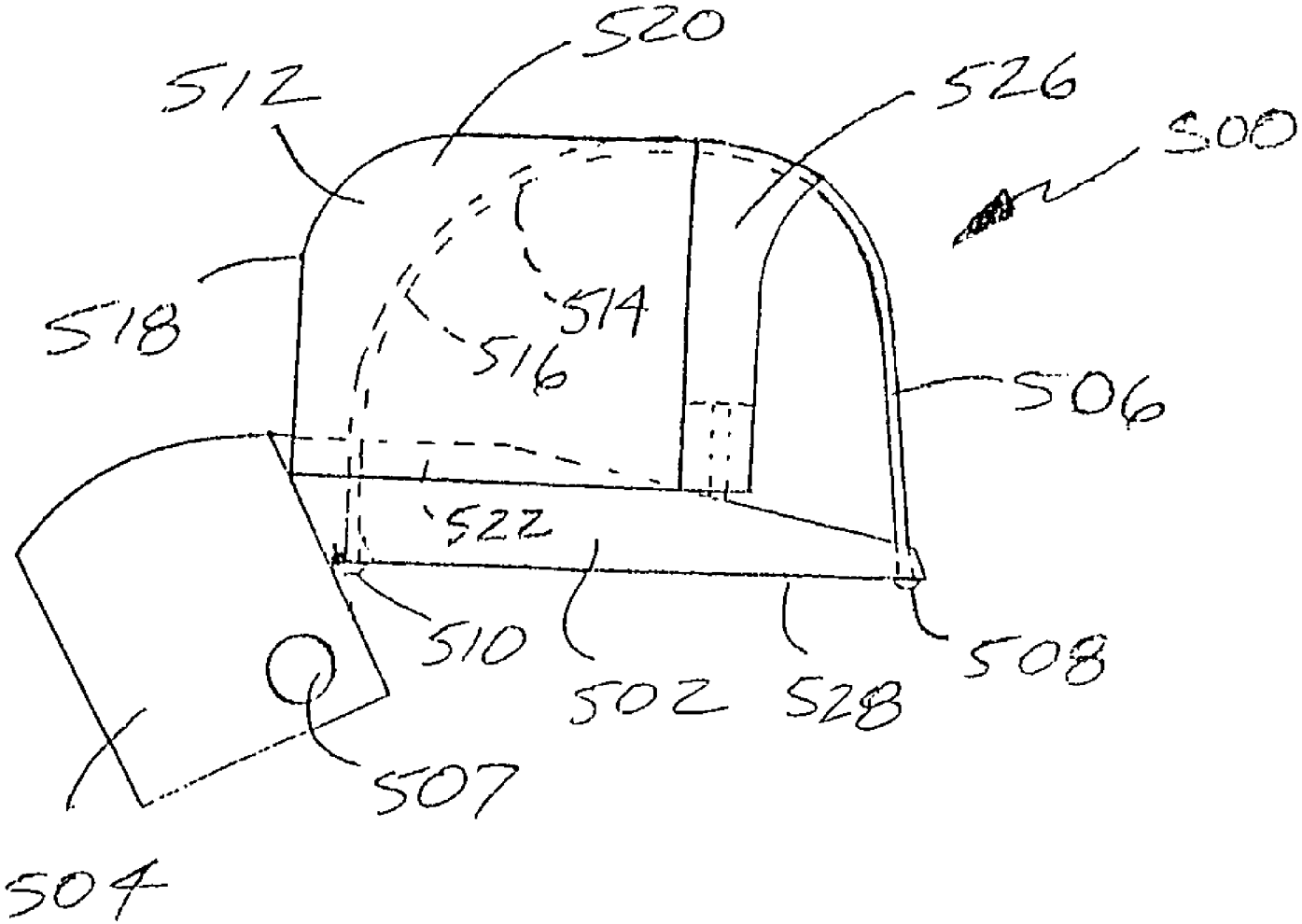
FIG. 20 is a view in elevation of the side of a fifteenth embodiment of the invention adapted for use in a pendulum-type bow sight.

FIG. 20 illustrates another embodiment of a sight pin assembly, generally indicated at 500, in accordance with the principles of the present invention. The sight pin assembly 500 is configured for use as a pendulum-type sighting mechanism. That is the sight pin assembly 500 can pivot freely about an axis to allow proper sighting of the bow as the bow is elevated or lowered. The sight pin 500 is comprised of a pin arm 502, a pin arm mounting portion 504, a fiber optic member 506 that is coupled at both ends 508 and 510 to the pin arm 502, and a fiber optic support/illuminating structure 512. The pin mounting portion 504 is provided with a transversely extending hole 507 so for mounting the pin 500 to a shaft upon which the pin 500 can freely pivot as needed. The structure 512 is comprised of a block of glow-in-the-dark material defining a channel 514 for receiving the fiber optic member 506 that extends from the base 516 of the channel to the outer surface 518 of the block. Thus, the structure 512 at least partially encapsulates a portion of the fiber optic member 506. The structure 512 is comprised a first portion 520 that has a width that is wider than the pin arm and defines a second channel 522 for receiving a portion of the pin arm 502. The width of the channel 522 is similar to that of the pin arm 502 so as to provide lateral stability to the structure 512 and thus to the fiber optic member 506. Thus the first portion 520 fits over a portion of the pin arm 502. The structure 512 also includes a second portion 526that has a width similar to that of the pin arm 502 when viewing the pin arm from a direction facing the front surface 528. The second portion 526 supports a portion of the fiber optic member 506 at the top portion of the arc thereof and terminates to allow the fiber optic member to be exposed for a length thereof. This exposed portion of the fiber optic member 506 allows the fiber optic member 506 to gather ambient light when conditions are sufficiently bright. As the ambient light is insufficient to adequately illuminate the fiber optic member 506, the structure 512 can be charged, either by exposing to bright light, a heat source, or other energy sources (for those glow-in-the-dark materials that can be charged for illumination by a source of energy other than light), to illuminate the fiber optic member 506.

While the present invention has been described with reference to certain embodiments to illustrate what is believed to be the best mode of the invention, it is contemplated that upon review of the present invention, those of skill in the art will appreciate that various modifications and combinations may be made to the present embodiments without departing from the spirit and scope of the invention as recited in the claims. The principles of the present invention may be adapted to any type of sight including those illustrated as well as pendulum type sights and the like. The claims provided herein are intended to cover such modifications and combinations and all equivalents thereof. Reference herein to specific details of the illustrated embodiments is by way of example and not by way of limitation.

What is claimed is:

1. A bow sight, comprising:

a pin guard having a pin attachment portion and defining a sight window;

at least one sight pin having a first end coupled to said pin attachment portion and a second free end extending into said sight window, said second free end defining an aperture transversely extending through said free end positioned proximate a center of said sight window when viewed from a front of the pin guard;

an elongate fiber optic member having a first end portion and a second end portion, said first end portion positioned within said aperture and retained by said second free end, a terminal end of said first end portion defining a bead forming a sight indicia within said sight window when viewing a front side of said at least one sight pin, said second end portion extending from a back side of said at least one sight pin to proximate said first end of said at least one sight pin, through an opening in said pin attachment portion and into a channel, said elongate fiber optic member being wrapped around said channel and retained therein.

2. The bow sight of claim 1, further comprising a non-electric, light-emitting member positioned within said channel and adjacent to said elongate fiber optic member to provide illumination thereto in conditions of low or absent ambient light.

3. The bow sight of claim 2, wherein said pin guard is comprised of an at least partially transparent material, said light-emitting member capable of illuminating at least a portion of said pin guard.

4. The bow sight of claim 2, wherein said elongate fiber optic member is disposed over said light-emitting member.

5. The bow sight of claim 1, wherein said pin guard defines a second opening for receiving said second end portion therein and retaining said second end portion relative thereto.

6. The bow sight of claim 5, wherein said second end portion defines a bead at a terminal end thereof for retaining said second end portion relative to said pin guard.

7. the bow sight of claim 1, wherein said transversely extending aperture has a length that is greater than a width of said aperture.

8. The bow sight of claim 1, wherein said at least one sight pin is integrally formed with said pin attachment portion.

9. A bow sight, comprising:

a pin guard having a pin attachment portion defining a sight window;

at least one sight pin having a first end affixed to said pin attachment portion and a second free end extending into said sight window, said second free end defining an aperture transversely extending through said second free end and positioned within said sight window;

an elongate fiber optic member having a first end portion and a second end portion, said first end portion positioned within said aperture and retained by said second free end, a terminal end of said first end portion defining a bead forming a sight indicia, said second end portion extending from a back side of said at least one sight pin to proximate said first end of said at least one sight pin and extending through an opening in said pin attachment portion;

a channel formed in an outer surface of said pin guard for receiving a portion of said elongate fiber optic member, said elongate fiber optic member being retained within said channel by wrapping.

10. The bow sight of claim 9, further comprising a non-electric, light-emitting member positioned within said channel and adjacent to said elongate fiber optic member to provide illumination thereto in conditions of low or absent ambient light.

11. The bow sight of claim 10, wherein said pin guard is comprised of an at least partially transparent material, said light-emitting member capable of illuminating at least a portion of said pin guard.

12. The bow sight of claim 10, wherein said elongate fiber optic member is disposed over said light-emitting member.

13. The bow sight of claim 9, wherein said pin guard defines a second opening for receiving said second end portion therein and retaining said second end portion relative thereto.

14. The bow sight of claim 13, wherein said second end portion defines a bead at a terminal end thereof for retaining said second end portion relative to said pin guard.

15. the bow sight of claim 9, wherein said transversely extending aperture has a length that is greater than a width of said aperture.

16. The bow sight of claim 9, wherein said at least one sight pin is integrally formed with said pin attachment portion.

17. The bow sight of claim 9, wherein said pin guard defines an opening for receiving said second end portion therein and retaining said second end portion relative thereto.

18. The bow sight of claim 17, wherein said second end portion defines a bead at a terminal end thereof for retaining said second end portion relative to said pin guard.

19. A bow sight, comprising:

a pin guard defining a sight window;

a sight pin having a first end coupled to said pin guard and a second free end extending into said sight window, said second free end defining a an aperture transversely extending through said free end positioned within said sight window;

an elongate fiber optic member having a first end portion and a second end portion, said first end portion positioned within said aperture and retained by said second free end, a terminal end of said first end portion defining a bead forming a sight indicia, said second end portion extending from a back side of said at least one sight pin to proximate said first end of said at least one sight pin and extending through said pin guard, said elongate fiber optic member having a wrapped portion to expose the elongate fiber optic member to ambient light.

20. The bow sight of claim 19, further comprising a channel associated with said pin guard for receiving said wrapped portion of said elongate fiber optic member.

21. The bow sight of claim 20, wherein said channel is formed in an outer surface of said pin guard, said elongate fiber optic member being retained within said channel by wrapping.

22. The bow sight of claim 20, further comprising a non-electric, light-emitting member positioned within said channel and adjacent to said elongate fiber optic member to provide illumination thereto in conditions of low or absent ambient light.

23. The bow sight of claim 22, wherein said pin guard is comprised of an at least partially transparent material, said light-emitting member capable of illuminating at least a portion of said pin guard.

24. The bow sight of claim 22, wherein said elongate fiber optic member is disposed over said light-emitting member.

25. the bow sight of claim 19, wherein said transversely extending aperture has a length that is greater than a width of said aperture.

26. The bow sight of claim 19, wherein said at least one sight pin is integrally formed with said pin attachment portion.

* * * * *